US011628671B2

(12) United States Patent
Tanaka

(10) Patent No.: US 11,628,671 B2
(45) Date of Patent: Apr. 18, 2023

(54) PRINTING APPARATUS

(71) Applicant: BROTHER KOGYO KABUSHIKI KAISHA, Nagoya (JP)

(72) Inventor: Mitsugi Tanaka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 44 days.

(21) Appl. No.: 17/123,460

(22) Filed: Dec. 16, 2020

(65) Prior Publication Data

US 2021/0178764 A1 Jun. 17, 2021

(30) Foreign Application Priority Data

Dec. 16, 2019 (JP) ..... JP2019-226848

(51) Int. Cl.
*B41J 2/15* (2006.01)
*B41J 11/00* (2006.01)

(52) U.S. Cl.
CPC ..... *B41J 2/15* (2013.01); *B41J 11/007* (2013.01)

(58) Field of Classification Search
CPC ..... B41J 11/001; B41J 11/005; B41J 11/007; B41J 2/15; B41J 11/0095; B41J 3/543; B41J 11/42
See application file for complete search history.

(56) References Cited

U.S. PATENT DOCUMENTS

2019/0168521 A1* 6/2019 Ihara ..... B41J 13/0009

FOREIGN PATENT DOCUMENTS

JP 2010173812 A 8/2010
JP 2010173821 A 8/2010

* cited by examiner

*Primary Examiner* — Jannelle M Lebron
(74) *Attorney, Agent, or Firm* — Scully, Scott, Murphy & Presser, P.C.

(57) ABSTRACT

There is provided a printing apparatus including: a head unit including two first heads and a second head; a support unit arranged to face the head unit and has a support surface; and a sensor arranged between a first virtual line extending in a conveyance direction so as to pass an end of a nozzle group area, of one of the two first heads, defined on a side of other of the two first heads and a second virtual line extending in the conveyance direction so as to pass an end of a nozzle group area, of the other of the two heads, defined on a side of the one of the two first heads, and arranged, in the conveyance direction, upstream of a nozzle group of the second head, the sensor including a projecting member which projects toward the supporting surface with respect to a nozzle surface.

18 Claims, 9 Drawing Sheets

PRINTING APPARATUS

CROSS REFERENCE TO RELATED APPLICATION

The present application claims priority from Japanese Patent Application No. 2019-226848, filed on Dec. 16, 2019, the disclosure of which is incorporated herein by reference in its entirety.

BACKGROUND

The present disclosure relates to a printing apparatus which detects the state of a medium.

As disclosed in Japanese Patent Application Laid-open No. 2010-173821, printing apparatuses such as printers include a model provided with a sensor for detecting a jam (paper jam) caused by a medium stuck or lodged in a print area in which a head is arranged. Further, the printing apparatuses include also a model provided with a sensor which detects the thickness of a sheet, presence or absence of the sheet, etc., in the print area, other than detecting the jam.

SUMMARY

An object of an aspect of the present disclosure is to arrange a sensor, which is configured to detect the state of a medium by detecting a state of contact (contact state) between the sensor and the medium, in an area in which a head unit and a supporting unit face each other.

In order to solve the above-described task, a printing apparatus according to an aspect of the present disclosure includes:

- a head unit including:
  - two first heads each has a nozzle surface having a nozzle group area in which a nozzle group configured to perform a printing on a medium is formed, the two heads being arranged with a gap in a crossing direction crossing a conveyance direction in which the medium is conveyed; and
  - a second head which has a nozzle group configured to perform the printing on the medium, and which is arranged, in the conveyance direction, downstream of the two first heads:
- a support unit which is arranged to face the head unit, and which has a support surface configured to support the medium; and
- a sensor arranged between a first virtual line extending in the conveyance direction so as to pass an end of the nozzle group area, of one of the two first heads, defined on a side of other of the two first heads and a second virtual line extending in the conveyance direction so as to pass an end of the nozzle group area, of the other of the two heads, defined on a side of the one of the two first heads, and arranged, in the conveyance direction, upstream of the nozzle group of the second head, the sensor including a projecting member which projects toward the supporting surface with respect to the nozzle surface.

According to an aspect of the present disclosure, it is possible to arrange the sensor, configured to detect the state of the medium by detecting the contact state between the sensor and the medium, in the area in which the head unit and the supporting unit face each other. The sensor is arranged in this area, and thus the sensor is not arranged at positions on the downstream side with respect to the nozzle group areas of the first heads in the conveyance direction and same as the positions of the nozzle group areas of the first heads in the crossing direction. With this, since the projecting member does not make any contact with the ink discharged or ejected from the first heads, the sheet is not dirtied or stained.

EMBODIMENTS

Figure 1:
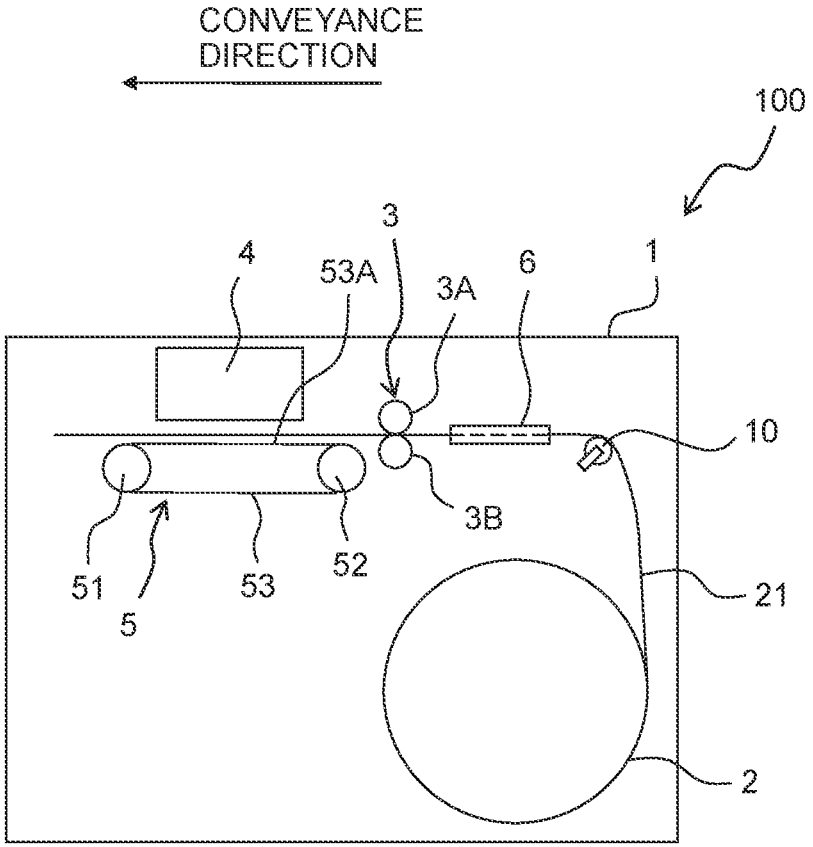
FIG. 1 is a side view depicting the configuration of a printing apparatus according to an aspect of the present disclosure.

An embodiment of the present disclosure will be explained as follows, based on FIGS. 1 to 9. FIG. 1 is a side view depicting the configuration of a printing apparatus 100 according to the embodiment. At first, the overview of respective parts, components, etc., of the printing apparatus 100 will be explained.

The printing apparatus 100 as depicted in FIG. 1 is a label printer of an ink-jet printing system. As depicted in FIG. 1, the printing apparatus 100 includes a casing 1, a roll paper holder 2, a conveying roller pair 3, a head unit 4, a platen 5 as an example of a "support unit", a guide mechanism 6, and a tensioner 10.

The casing 1 is an exterior body accommodating the roll paper holder 2, the conveying roller pair 3, the head unit 4, the platen 5 and the guide mechanism 6. Further, the casing 1 also include a structure holding the roll paper holder 2, the conveying roller pair 3, the head unit 4, the platen 5 and the guide mechanism 6.

The roll paper holder 2 holds a roll paper 21 as an example of a "medium", and is driven to rotate by a motor (not depicted in the drawings) to thereby feed or send out the roll paper 21. The roll paper 21 is wound around the roll paper holder 2 in a roll shape.

The tensioner 10 is a roller which applies tension to the roll paper 21 which is pulled out from the roll paper holder 2 to a conveyance path. The tensioner 10 is rotatably supported on the casing 1.

The conveying roller pair 3 has a conveying roller 3A and a pressing roller 3B, and is provided on the conveying path in which the roll paper 21 is conveyed. The conveying roller 3A is rotatably supported on (by) the casing 1, and is driven to rotate by a motor (not depicted in the drawings). The pressing roller 3B is a roller which presses the roll paper 21 with respect to the conveying roller 3A, and which is rotatably provided on the casing 1. The conveying roller pair 3 rotates while sandwiching or pinching the roll paper 21 therebetween to thereby convey the roll paper 21 fed from the roll paper holder 2 in the conveyance direction.

The head unit 4 is arranged on the downstream side in the conveyance direction with respect to the conveying roller pair 3 so as to perform printing on the roll paper 21. The head unit 4 is supported by the casing 1. The head unit 4 will be explained in detail later on.

The platen 5 is provided so as to support the roll paper 21, which is (being) conveyed by the conveying roller pair 3, in a printing area in which the printing is performed by the head unit 4. The platen 5 supports the roll paper 21 at a position which is below the head unit 4 and at which the platen 5 faces the head unit 4.

The platen 5 is arranged at the location below the head unit 4. The platen 5 has a driving roller 51, a driven roller 52 and an endless conveying belt 53. The conveying belt 53 is stretched over the driving roller 51 and the driven roller 52 which are arranged at a spacing distance therebetween (with a gap therebetween), and is configured to convey the roll paper 21. The upper surface of the conveying belt 53 is allowed to serve as a supporting surface 53A supporting the roll paper 21. The driving roller 51 and the driven roller 52 are supported by the casing 1.

Note that the platen 5 may be a supporting plate provided with rib(s) supporting the lower surface of the roll paper 21, instead of the conveying mechanism with the conveying belt 53. Further, such a supporting plate may be provided with an air hole(s) configured to adhere the roll paper 21 thereto by suction of air. Furthermore, the conveying belt 53 may be a belt having an attracting function such as a belt configured to attract the roll paper 21 thereto by air suction, a belt configured to attract the roll paper 21 thereto by electrostatic attraction, etc.

The guide mechanism 6 performs positioning for the roll paper 21, which is (being) conveyed in the conveyance path, in a width direction thereof, to thereby guide the roll paper 21 to an appropriate conveyance direction. The guide mechanism 6 is arranged between the tensioner 10 and the conveying roller pair 3. The guide mechanism 6 will be explained in detail later on.

Figure 2:
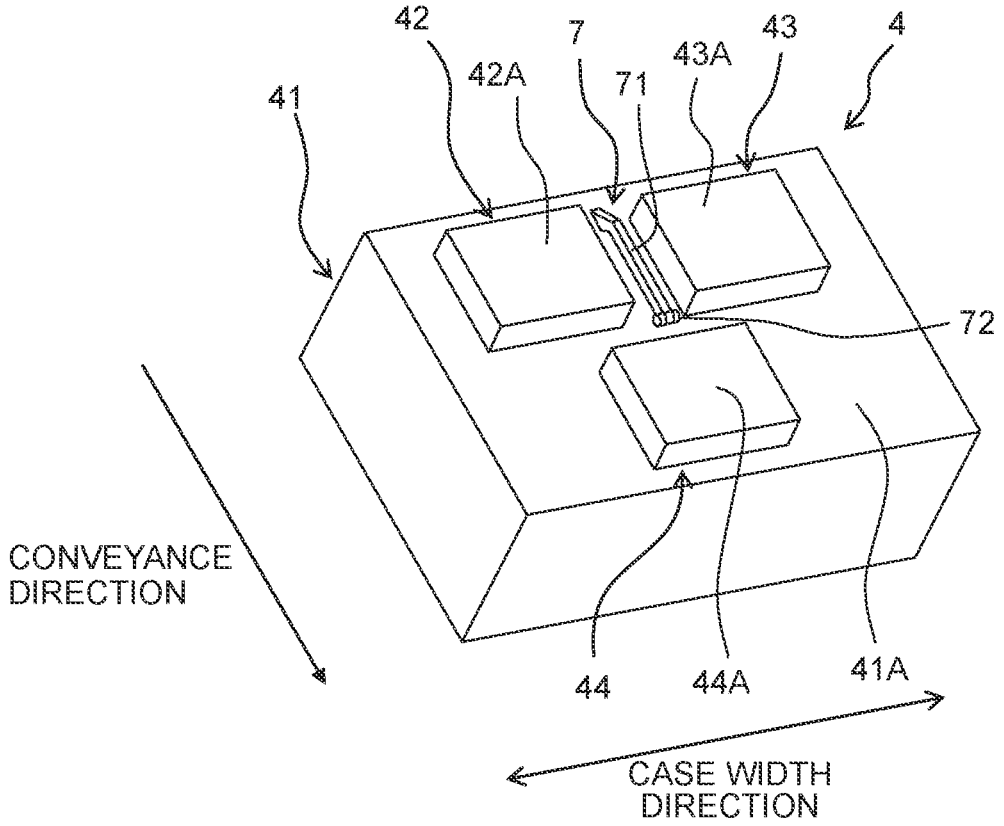
FIG. 2 is a perspective view depicting the configuration of a head unit provided on the printing apparatus.
Figure 3:
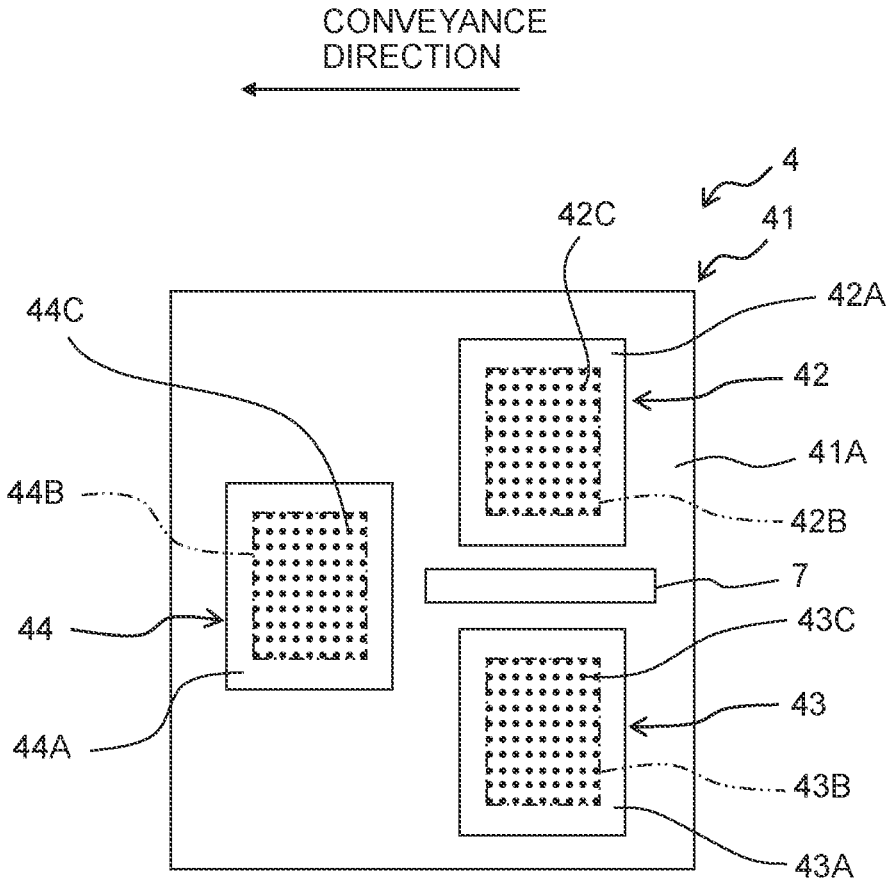
FIG. 3 is a bottom view depicting the configuration of the head unit.
Figure 4:
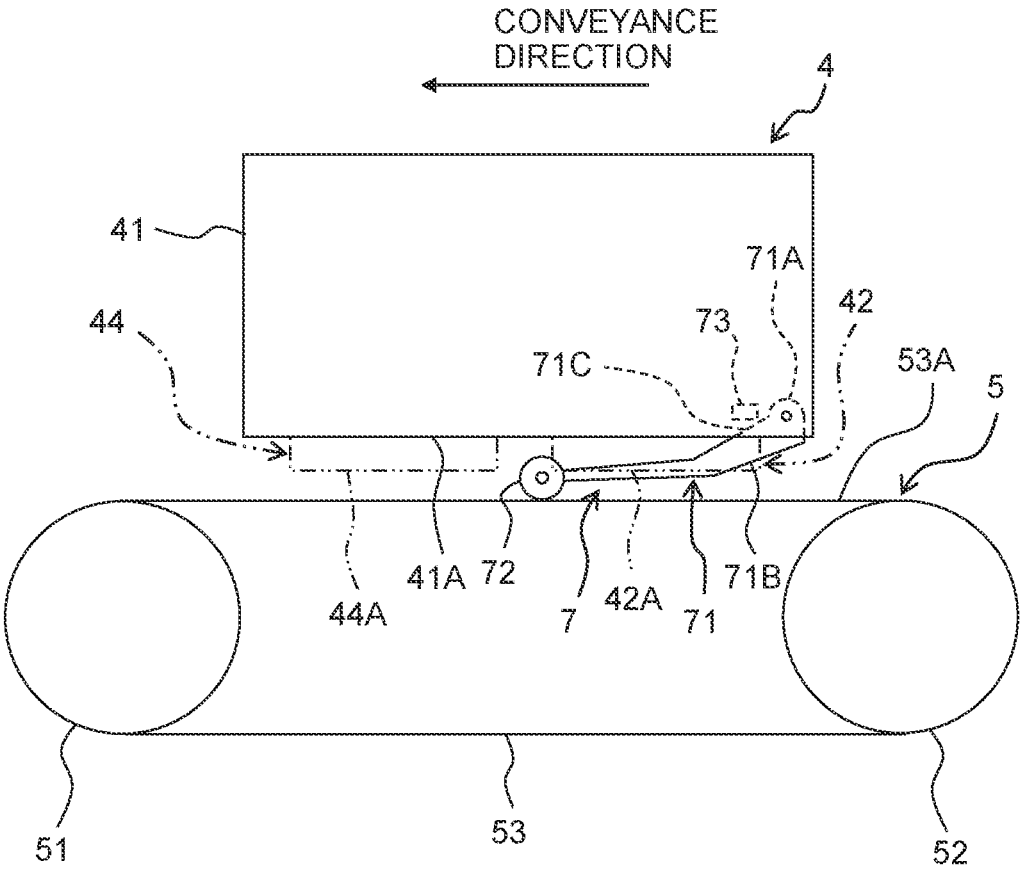
FIG. 4 is a side view depicting the arrangement of the head unit and a platen in the printing apparatus.
Figure 5:
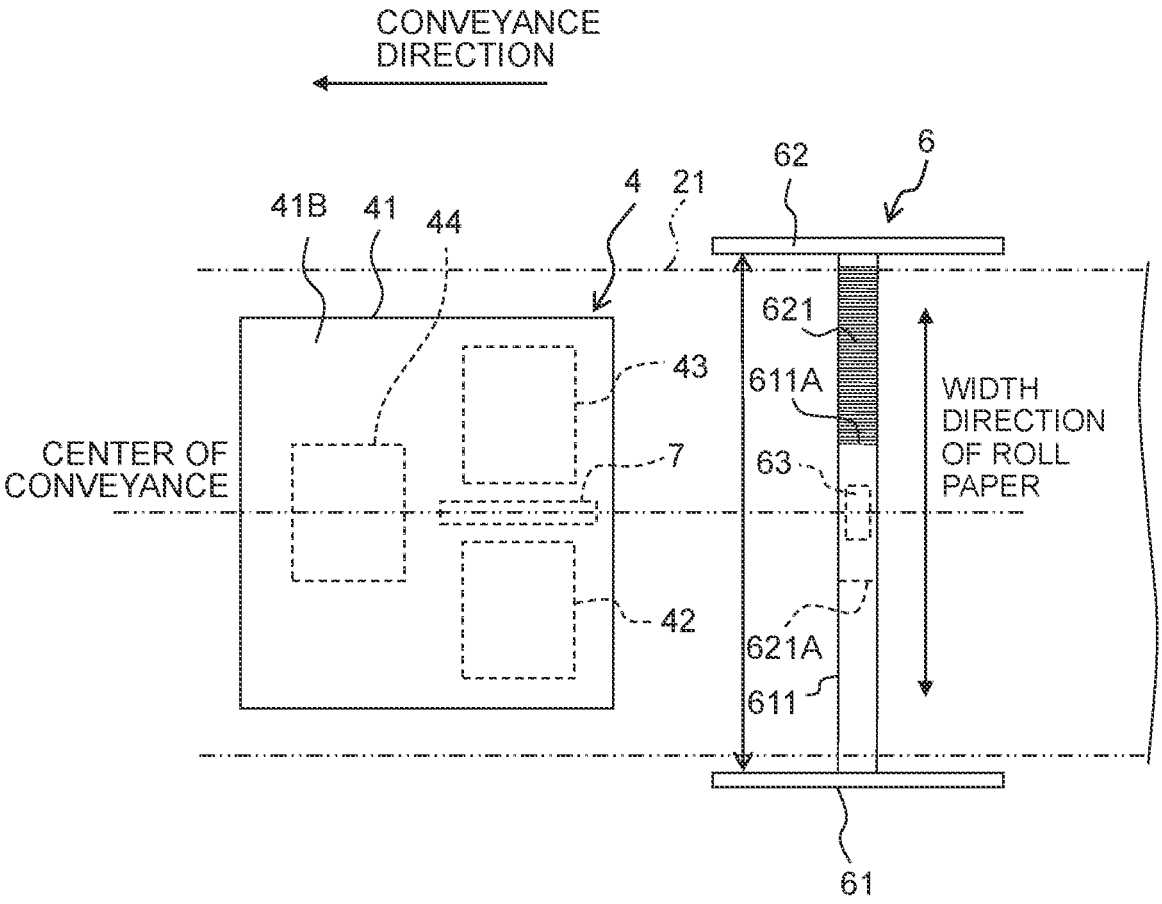
FIG. 5 is a plan view depicting the arrangement of the head unit and a guide mechanism in the printing apparatus.

Next, the head unit 4 will be explained in detail. FIG. 2 is a perspective view depicting the configuration of the head unit 4. FIG. 3 is a bottom view depicting the configuration of the head unit 4. FIG. 4 is a side view depicting the arrangement of the head unit 4 and the platen 5. FIG. 5 is a plan view depicting the arrangement of the head unit 4 and the guide mechanism 6.

The head unit 4 has a case 41, a head 42 and a head 43 each as an example of a "first head", and a head 44 as an example of a "second head". Further, the sensor 7 is provided on the head unit 4.

The case 41 is formed to have a box shape; a tube via which an ink is introduced from an ink tank to the heads 42 to 44, etc., is arranged in the inside of the case 41. The heads 42 to 44 configured to perform printing on the roll paper 21 are attached to a head placement surface 41A, of the case 41, which faces the platen 51. The head unit 4 is arranged so that the head placement surface 41A is oriented to face the supporting surface 53A of the platen 5.

The heads 42 and 43 are arranged side by side, at a spacing distance therebetween (with a gap between), in a crossing direction crossing the conveyance direction, for example, a width direction, of the case 41, which is orthogonal to the conveyance direction and a thickness direction of the case 41 (the width direction of the case 41 will be referred to as a "case width direction" hereinbelow). The head 44 is arranged on the downstream side in the conveyance direction with respect to the heads 42 and 43 and at a center in the width direction of the case 41.

As depicted in FIG. 5, the heads 42 and 43 are arranged at positions which are linearly symmetric with respect to the center of conveyance (conveyance center) of the roll paper 21. Namely, the heads 42 and 43 as the first heads are arranged such that a same number, which is 1 (one), of the first heads is arranged at each of the positions which are linearly symmetric with respect to the conveyance center.

Note that although the head unit 4 has the two heads 42 and 43 as the first head, the head unit 4 may have not less than one piece of a head which has a similar configuration to that of the heads 42 and 43. Such a head is arranged side by side, together with the heads 42 and 43, at a spacing distance therebetween in the case width direction.

As depicted in FIG. 3, the heads 42 to 44 have nozzle surfaces 42A to 44A, respectively. Nozzle group areas 42B to 44B are provided on the nozzle surfaces 42A to 44A, respectively. Nozzle groups, constructed of large numbers of nozzles 42C to 44C are provided in the nozzle group areas 42B to 44B, respectively.

The sensor 7 is provided so as to detect the state of the roll paper 21 which is (being) conveyed on the platen 5. The state of the roll paper 21 is exemplified by jam (paper jam) of the roll paper 21 in the print area on the supporting surface 53A of the platen 5, the thickness of the roll paper 21, the presence or absence of the roll paper 21, etc.

The sensor 7 is arranged on the upstream side in the conveyance direction with respect to the nozzle group 44C of the head 44, and in the conveyance center between the nozzle group areas 42B and 43B of the two heads 42 and 43 in the case width direction. Further, as depicted in FIG. 4, the sensor 7 has an arm 71, a roller 72 as an example of a "projecting member", and a detector 73.

The arm 71 is formed to have a shape extending along the conveyance direction, and supports the roller 72 to be rotatable at an end part on one side of the arm 71, as an example of a "first end". The roller 72 projects toward the supporting surface 53A of the platen 5, with respect to the nozzle surface 42A of the head 42. Also regarding the head 43 which is hidden by the head 42 in FIG. 4, the roller 72 projects toward the supporting surface 53A of the platen 5, with respect to the nozzle surface 43A of the head 43.

As depicted in FIG. 4, the arm 71 has a rotation-supporting part 71A on an end part on the other side of the arm 71 as an example of a "second end part", and the arm 71 is supported, by the rotation-supporting part 71A, on the case 41. With this, the arm 71 is movable in the up-down direction between the head unit 4 and the platen 5.

The arm 71 has an inclined surface 71B which is formed on the upstream side in the conveyance direction, that is a part ranging from the rotation-supporting part 71A up to an intermediate part of the arm 71, and formed at a portion facing the supporting surface 53A of the platen 5. The inclined surface 71B is inclined such that more downstream part is closer to the supporting surface 53A. The inclined surface 71B guides a forward end of the roll paper 21 which is introduced to the print area between the head unit 4 and the platen 5.

The arm 71 is biased toward the platen 5 so that the roller 72 presses the supporting surface 53A of the platen 5. Specifically, the arm 71 is biased, for example, by a compression spring (not depicted in the drawings) in the inside of the case 41. With this, the roller 72 is biased toward the supporting surface 53A.

The detector 73 detects a moving amount, of a vicinity part 71C of the rotation-support part 71A of the arm 71, which accompanies the rotation of the arm 71. In the moving amount detected by the detector 73, the magnitude of the detected moving amount is different depending on the state of the roll paper 21 as an object of the detection by the above-described sensor 7. For example, in case that the jam is detected, the moving amount of the arm 71 is great due to a stuck or lodged roll paper 21; on the other hand, in a case that the thickness and/or the presence or absence of the roller paper 21 are/is detected, the movement amount of the arm 71 is small.

As the detector 73, an optical detector, a contact-type detector, etc., is used. For example, the optical detector has a light emitting part and a light receiving part, and detects that the arm 71 is moved in not less than a predetermined amount based on a change from a state in which the light receiving part can receive the light from the light emitting part (that is, a state in a base period) to a state in which the light receiving part cannot receive the light from the light emitting part due to shielding by the arm 71. The detector of the contact type is arranged at a location above the arm 71; the detector is switched OFF in a case that an upper surface of the arm 71 does not make contact with the detector, and the detector is switched ON in a case that the arm 71 pivots to the side of the head placement surface 41A of the case 41 and the detector makes contact with the upper surface of the arm 71, thereby detecting that the arm 71 is moved in not less than the predetermined amount.

Next, the guide mechanism 6 will be explained in detail. The guide mechanism 6 depicted in FIG. 5 regulates the position in the width direction of the roll paper 21 to thereby guide the roll paper 21 to a correct conveyance direction. The guide mechanism 6 has guide plates 61 and 62, racks 611 and 621, and a pinion 63.

The guide plates 61 and 62 are plate-shaped members which are arranged to face each other. The guide plates 61 and 62 are held by the casing 1 so as to be slidable in the width direction of the roll paper 21. The guide plates 61 and 62 regulate positions of side edges of the roll paper 21.

The rack 611 is attached to the guide plate 61 so that the rack 611 extends toward the guide plate 62 from a surface, of the guide plate 61, facing the guide plate 62. The rack 621 is attached to the guide plate 62 so that the rack 621 extends toward the guide plate 61 from a surface, of the guide plate 62, facing the guide plate 61.

The rack 611 is arranged so that a surface, of the rack 611, having teeth is oriented (faces) downward. On the other hand, the rack 621 is arranged at a location below the rack 611 so that a surface, of the rack 621, having teeth is oriented (faces) upward. Further, the racks 611 and 621 are arranged so that parts of the racks 611 and 621, respectively, face each other. As depicted in FIG. 5, an end part 611A of the rack 611 is located at a position above the rack 621, and an end part 621A of the rack 621 is located at a position below the rack 611.

The pinion 63 is supported by the casing 1 so that the pinion 63 is rotatable at the conveyance center in a range or area in which the racks 611 and 621 face each other.

Further, the pinion 63 is arranged to mesh with the teeth of the racks 611 and 621.

In the guide mechanism 6 which is configured as described above, in a case that the guide plate 61 is moved by a user in the width direction of the roll paper, the rack 611 also moves in a moving direction of the guide plate 61. This rotates the pinion 63 meshed with the rack 611. Accompanying with the rotation of the pinion 63, the rack 621 meshed with the pinion 63 moves in a direction opposite to the moving direction of the rack 611. Then, the guide plate 62 moves in a same direction as the moving direction of the rack 621.

Moving amounts of the racks 611 and 621 are same, in accordance with a rotation amount of the pinion 63. Accordingly, the guide plate 62 moves in a same moving amount as that of the guide plate 61. This is similarly applicable also to a case of moving the guide plate 62. With this, in a case that one of the guide plates 61 and 62 is moved and thus the other of the guide plates 61 and 62 is moved, the distances of the guide plates 61 and 62, respectively, with respect to the conveyance center are same all the time. Therefore, even in a case that the width of the roll paper 21 is changed, the positions of the guide plates 61 and 62 are adjusted so as to make the center of the roll paper 21 to be always coincident with the conveyance center of the printing apparatus 100, thereby making it possible to guide the roll paper 21 to the correct conveyance direction.

In the printing apparatus 100 according to the present embodiment, the head unit 4 has the sensor 7. The sensor 7 is arranged on the upstream side in the conveyance direction with respect to the head 44, and between the heads 42 and 43. With this, the sensor 7 does not make any contact with the ink discharged or ejected from the heads 42 and 43 toward the roll paper 21. Accordingly, it is possible to avoid such a situation that a part or portion, of the roll paper 21, for which the printing has been performed, is dirtied or stained.

Further, the sensor 7 is arranged at a position in the vicinity of the conveyance center in the head placement surface 41A. With this, the sensor 7 is capable of also functioning as a pressing mechanism which presses the roll paper 21 at a location below the head unit 4. Furthermore, in such a case that any jam of the roll paper 21 occurs at the location below the head unit 4, it is possible to detect the jam promptly. Specifically, it is possible to detect a minute floating or lifting of the roll paper 21 which serves as a sign of the jam. With this, by stopping the conveyance of the roll paper 21 before the occurrence of jam, it is possible to prevent the jam in advance. For example, under a condition that the roll paper 21 floats from the supporting surface 53A of the platen 5 by 0.5 mm, the conveyance of the roll paper 21 is stopped.

Further, the roller 72 of the sensor 7 projects towards the supporting surface 53A with respect to the nozzle surfaces 42A and 43A of the heads 42 and 43. With this, the sensor 7 is capable of detecting the state of the roll paper 21 which passes on the platen 5 facing the heads 42 and 43, depending on the contact state of the roller 72 and the roll paper 21. Accordingly, it is possible to detect the state of the roll paper 21 more quickly, as compared with a conventional technique wherein the state of the roll paper 21 is detected after the front end of the roll paper 21 passes all the heads.

Further, the roller 72 of the sensor 7 is biased toward the supporting surface 53A. With this, it is possible to press, by the roller 72, any floating of the roll paper 21 between the heads 42 and 43 which are adjacent to each other. This makes it possible to perform the printing stably.

Furthermore, since the sensor 7 has the roller 72, it is thus possible to press the roll paper 21 while rotating on the roll paper 21 which is moving. Accordingly, it is possible to detect the state of the roll paper 21 without hindering the conveyance of the roll paper 21.

Moreover, the arm 71 of the sensor 7 extends along the conveyance direction.

With this, the roller 72, located on the downstream side in the conveyance direction with respect to the rotation-supporting part 71A at which the arm 71 is supported, rotates on the roll paper 21. With this, it is possible to detect the state of the roll paper 21 smoothly, without resisting against the conveyance of the roll paper 21.

Further, the arm 71 guides the forward end of the roll paper 21 by the inclined surface 71B. With this, it is possible to press any floating of the roll paper 21 which is easily curl during the conveyance. Accordingly, it is possible to introduce the roll paper 21 stably onto the supporting surface 53A.

Furthermore, the arm 71 has the detector 73. With this, the roller 72 makes contact with the roll paper 21 which is being conveyed, while the roller rotates on the roll paper 21, thereby allowing the state of the roll paper 21 to be transmitted to the roller 72. For example, in a case that any jam of the roll paper 21 occurs, the first end part, of the arm 71, which supports the roller 72 is lifted upward by the roll paper 21, thereby allowing the arm 71 to rotate, which in turn uplifts the vicinity part 71C of the second end part, of the arm 71, which is on the side opposite to the first end part of the arm 71. Based on the moving amount of the vicinity part 71C in this situation, it is possible to detect whether or not any jam is occurring in the roll paper 21, namely, whether or not the roll paper 21 is being conveyed normally.

Moreover, the heads 42 and 43 are arranged at the positions which are linearly symmetric with respect to the conveyance center of the roll paper 21. With this, the sensor 7 is consequently arranged on the conveyance center between the heads 42 and 43.

Therefore, the sensor 7 is capable of detecting the state of the roll paper 21 further correctly at the conveyance center.

Further, the platen 5 has the conveying belt 53. With this, even in such a case that a conveying power for conveying the roll paper 21 is lowered at a location below the heads 42 to 44, it is possible to supplement, by the conveying belt 53, the conveying power for the roll paper 21.

Figure 6:
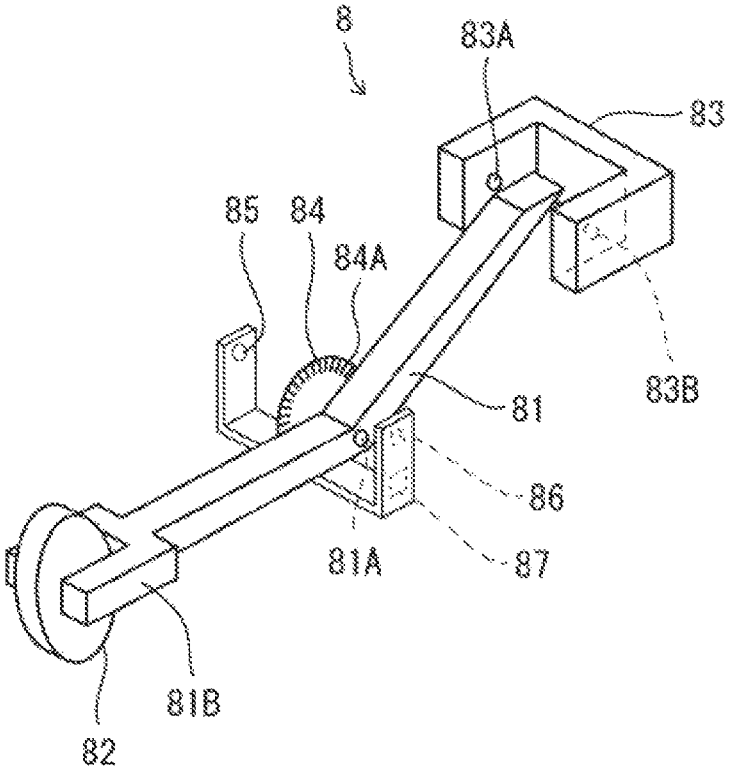
FIG. 6 is a perspective view depicting the configuration of a sensor according to a modification of the printing apparatus.
Figure 7:
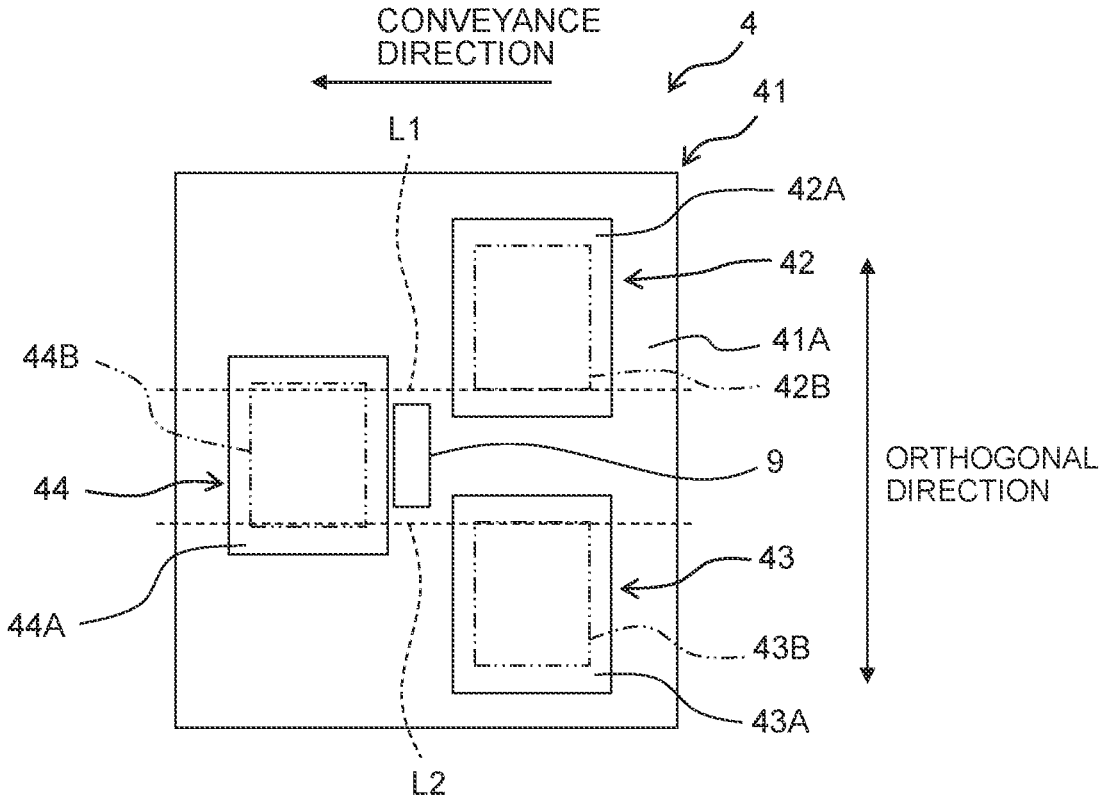
FIG. 7 is a bottom view depicting the configuration of a head unit according to a modification of the printing apparatus.
Figure 8:
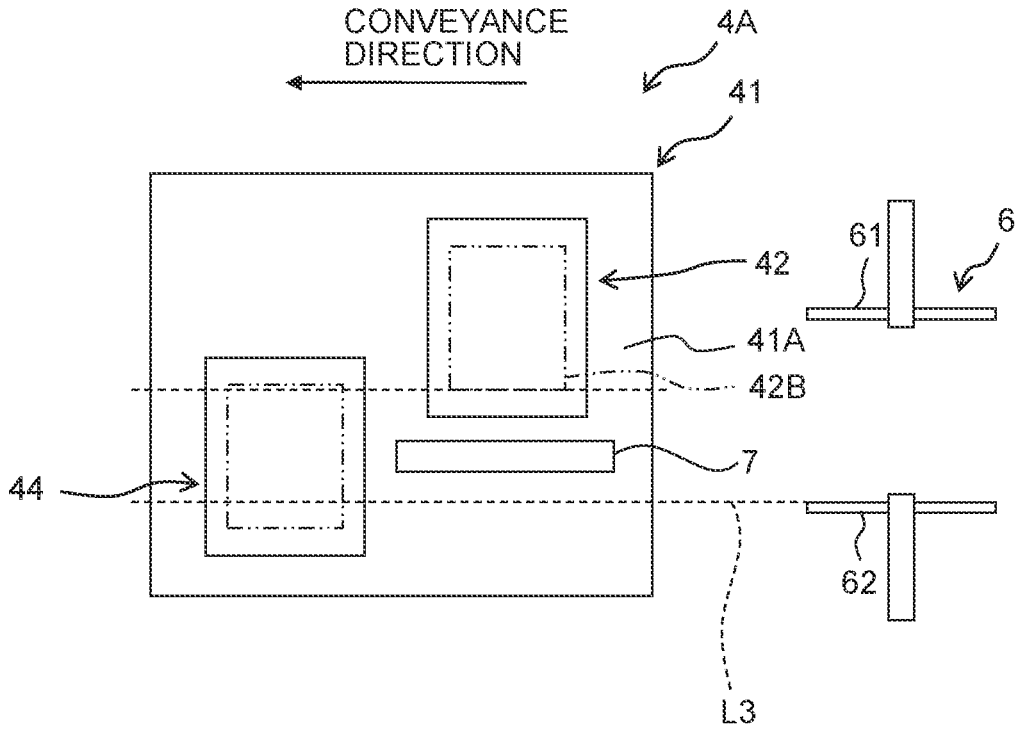
FIG. 8 is a bottom view depicting another configuration of a head unit according to a modification of the printing apparatus.
Figure 9:
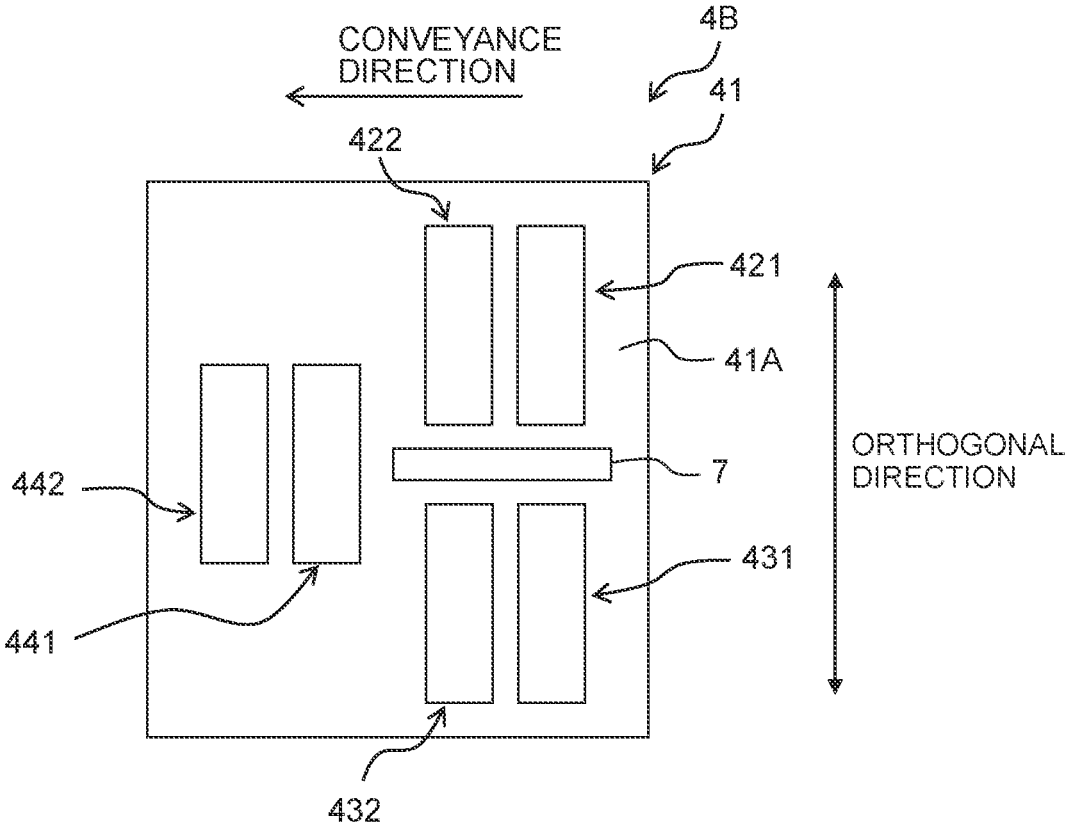
FIG. 9 is a bottom view depicting yet another configuration of a head unit according to a modification of the printing apparatus.

Next, modifications of the present disclosure will be explained. FIG. 6 is a perspective view depicting the configuration of a sensor 8 according to a modification of the printing apparatus 100. FIG. 7 is a bottom view depicting the configuration of ahead unit 4 according to a modification of the printing apparatus 100. FIG. 8 is a bottom view depicting the configuration of another head unit 4A according to a modification of the printing apparatus 100. FIG. 9 is a bottom view depicting the configuration of yet another head unit 4B according to a modification of the printing apparatus.

The head unit 4 of the printing apparatus 100 may have a sensor 8 depicted in FIG. 6, instead of the above-described sensor 7. The sensor 8 has an arm 81, a roller 82 and a detector 83. The sensor 8 is also arranged at a position, which is similar to the position of the sensor 7, in the head unit 4.

The arm 81 is formed to have a shape which is bent in an intermediate part thereof, and is rotatably supported on the case 41 of the head unit 4, at a rotational center 81A at the intermediate part. The arm 81 rotatably supports the roller 82 by a supporting part 81B provided on one end part, of the arm 81, as an example of the "first end". The detector 83 has a light-emitting part 83A and a light-receiving part 83B which are arranged at positions, respectively, facing each other. The arm 81 is arranged so that the other end part, of the arm 81, as an example of the "second end", moves in an area between the light-emitting part 83A and the light-receiving part 83B of the detector 83.

In the sensor 8 configured as described above, in a case that the sensor 8 does not detect any state of the roll paper 21, the second end part of the arm 81 is located at a position at which the second end part of the arm 81 does not shield (hinder) the light emitted from the light-emitting part 83A and arriving at the light-receiving part 83B; in a case that the sensor 8 detects some state of the roll paper 21, the second end part of the arm 81 is located at a position at which the second end part shields (hinders) the above-described light. With this, the sensor 8 is capable of detecting the state of the roll paper 21, similarly to the sensor 7.

Further, the sensor 8 may be configured to detect the thickness of the roll paper 21. Specifically, as depicted in FIG. 6, a circular arc plate 84, which is formed as a circular-arc shaped plate about the rotational center 81A, is provided on the arm 81 of the sensor 8. A plurality of slits 84A are formed in the circular arc plate 84, with equal spacing distances therebetween (at regular intervals). Further, a light-emitting element 85 arranged at a reference position on a side of one surface of the circular arc plate 84, and a light-receiving element 86 which receives a light passing through the slits 84A are provided. In a case that the light-receiving element 86 receives the light emitted from the light-emitting element 85 and passing through the slits 84A, the light-receiving element 86 outputs a light-receiving signal. Further, a counter 87, which counts the number of the light-receiving signal outputted from the light-receiving element 86 in accordance with the inclination of the arm 81, is further provided.

With the above-described configuration, the light-receiving signal, like a pulsed signal, is outputted from the light-receiving element 86 since the light allowed to pass through the slits 84A, or not allowed to pass through the slits 84A, in a process in which the arm 81 is being inclined. The counter 87 counts the number of the light-receiving signal and based on the number of the count, it is possible to detect the thickness of the roll paper 21. As the thickness of the roll paper 21 is greater, the arm 84 is inclined to a greater extent, which in turn increase the number of the pulses of the light-receiving signal depending on the inclination angle of the arm 81.

Further, a sensor 9 will be explained. As depicted in FIG. 7, the head unit 4 of the printing apparatus 100 may have the sensor 9, instead of the above-described sensor 7.

In a case that an area in which the sensor 9 is to be arranged is narrow, and that the sensor 9 is not capable of having an arm like the arm 71 possessed by the sensor 7, the sensor 9 may have a configuration wherein a stick-like member, which is movable in the thickness direction of the head unit 4 depending on the upward/downward movement of the roll paper 21, turns a switch ON. A forward end, of the stick-like member as an example of the "projecting member", protrudes toward the supporting surface 53A with respect to the nozzle surfaces 42A and 43A of the heads 42 and 43.

The sensor 9 including the above-described protruding member is arranged on the upstream side in the conveyance direction with respect to the head 44, between a virtual line L1 and a virtual line L2. The virtual line L1 is a virtual line extending in the conveyance direction and passing, in an orthogonal direction, an end part of the nozzle group area 42B defined on a side of the head 43, the orthogonal direction being a direction along the nozzle surfaces 42A and 43A of the heads 42 and 43 and orthogonal to the conveyance direction. The virtual line L2 is a virtual line extending in the conveyance direction and passing, in the above-described orthogonal direction, an end part of the nozzle group area 43B defined on a side of the head 42.

In an example depicted in FIG. 7, the virtual lines L1 and L2 pass, in the orthogonal direction, the entireties of the above-described end parts of the nozzle group area 42B and 43B, respectively, namely, pass so as to overlap with the end parts, respectively. Such virtual lines L and L2 include parts overlapping with the above-described end parts of the nozzle group areas 42B and 43B, respectively. In contrast, in a case that the above-descried end parts of the nozzle group areas 42B and 43B are inclined with respect to the conveyance direction, the virtual line L1 and L2 pass, in the orthogonal direction, the above-described end parts of the nozzle group areas 42B and 43B, respectively, so that the virtual lines L1 and L2 cross the end parts, respectively, each at one point.

Also in a case that the printing apparatus 100 is provided with the head unit 4 having the sensor 9 such as above, the sensor 9 is capable of detecting the state of the roll paper 21 passing on the supporting surface 53A facing the heads 42 and 43, depending on a contact state between the stick-like member and the roll paper 21. Accordingly, it is possible to detect the state of the roll paper 21 more quickly, as compared with a conventional technique wherein the state of the roll paper 21 is detected after the front end of the roll paper 21 passes all the heads.

Next, the head unit 4A will be explained. As depicted in FIG. 8, the head 43 in the head unit 4 is omitted in the head unit 4A. The remaining configuration of the head unit 4A is same as that of the head unit 4. The sensor 7 is arranged between a virtual line L3 which extends from a surface of the guide plate 62 as one of the guide plates 61 and 62 along the conveyance direction without passing the head 42, and an end part, of the nozzle group area 42B in the head 42, defined on a side closer to the virtual line L3. Also with the head unit 4A having such a configuration, it is possible to obtain the effect similar to that obtained by the above-described head unit 4.

Further, the head unit 4B will be explained. As depicted in FIG. 9, the head unit 4B has such a configuration wherein the head 42 in the head unit 4 is replaced by two heads 421 and 422 as an example of the "first head", and the head 43 in the head unit 4 is replaced by two heads 431 and 432 as an example of the "first head". Furthermore, the head unit 4B has such a configuration wherein the head 44 in the head unit 4 is replaced by two heads 441 and 442 as an example of the "second head".

Each of the heads 421 and 422 is formed to be elongated in the above-descried orthogonal direction, and the heads 421 and 422 are arranged side by side in the conveyance direction at a position same as the position as which the head 42 is arranged. Each of the heads 431 and 432 is formed to be elongated in the above-descried orthogonal direction, and the heads 431 and 432 are arranged side by side in the conveyance direction at a position same as the position as which the head 43 is arranged. Each of the heads 441 and 442 is formed to be elongated in the above-descried orthogonal direction, and the heads 441 and 442 are arranged side by side in the conveyance direction at a position same as the position as which the head 44 is arranged. Also with the head unit 4B having such a configuration, it is possible to obtain the effect similar to that obtained by the above-described head unit 4.

Further, in each of the set of the heads 421 and 422, the set of the heads 431 and 432 and the set of the heads 441 and 442, it is allowable to make the colors of the inks discharged or ejected from the respective heads to be different from each other. For example, it is allowable that each of the heads 421, 431 and 441 arranged on the upstream side in the conveyance direction discharges or ejects K (black) and Y (yellow) inks, and that each of the heads 422, 432 and 442 arranged on the downstream side in the conveyance direction discharges or ejects C (cyan) and M (magenta) inks. With this, it is possible to perform a four-color printing in each of the set of the heads 421 and 422, the set of the heads 431 and 432 and the set of the heads 441 and 442.

In each of the set of the heads 421 and 422, the set of the heads 431 and 432 and the set of the heads 441 and 442, it is allowable to arrange the two heads to be shifted from each other in the orthogonal direction. For example, it is assumed that each of the heads 421 and 422, each of the heads 431 and 432, and each of the heads 441 and 442 has the nozzles at a density of 300 dpi (dot per inch). The positions of the nozzles are shifted in the orthogonal direction between each of the heads 421 and 422, between the heads 431 and 432, and between the heads 441 and 442. Accordingly, an arrangement position of the head 421 with respect to the head 422, an arrangement position of the head 431 with respect to the head 432, and an arrangement position of the head 441 with respect to the head 442 are each shifted in the orthogonal direction. With this, it is possible to provide a configuration so that each of the set of the heads 421 and 422, the set of the heads 431 and 432 and the set of the heads 441 and 442 is capable of having the nozzle at a density of 600 dpi.

Note that in the embodiment described above, the explanation has been made regarding the configuration wherein the printing apparatus 100 is the label printer. The present embodiment, however, is not limited to or restricted by being the label printer; the present embodiment is applicable also to a printing apparatus configured to perform printing on medium different from the sheet-like medium, such as a case for mobile phone, a golf ball, a tablet (pill), etc., or a printing apparatus configured to print a trace on a circuit board, etc.

The present invention is not limited to the embodiment described above, and various changes can be made within the scope of the claims; a configuration which is obtained by appropriately combining the technical means disclosed in the embodiment described above is also included in the technical scope of the present invention.

What is claimed is:

1. A printing apparatus comprising:

a head unit including:

a first head which has a nozzle surface having a nozzle group area in which a nozzle group configured to perform a printing on a medium is formed, a second head which has a nozzle group configured to perform the printing on the medium, and which is arranged downstream of the first head in a conveyance direction in which the medium is conveyed, a support unit which is arranged to face the head unit, and which has a support surface configured to support the medium; and a sensor which is arranged upstream of the nozzle group of the second head such that the sensor and the nozzle group of the second head overlap as seen in the conveyance direction, the sensor being arranged in a crossing direction crossing the conveyance direction at a position different from the nozzle group area of the first head, the sensor including a projecting member which projects toward the supporting surface with respect to the nozzle surface, wherein the first head includes two heads each has the nozzle surface having the nozzle group area in which the nozzle group configured to perform the printing on the medium is formed, the two heads being arranged with a gap in the crossing direction; and the sensor is arranged between a first virtual line extending in the conveyance direction so as to pass an end of the nozzle group area, of one of the two heads of the first head, defined on a side of other of the two heads of the first head and a second virtual line extending in the conveyance direction so as to pass an end of the nozzle group area, of the other of the two heads of the first head, defined on a side of the one of the two heads of the first head.

2. The printing apparatus according to claim 1, wherein the projecting member is arranged, in the crossing direction, between the nozzle group areas of the two heads of the first head.

3. The printing apparatus according to claim 1, wherein the first head includes three or more heads arranged such that two of the three or more heads are arranged with the gap in the crossing direction.

4. The printing apparatus according to claim 1, wherein the two heads of the first head are arranged line symmetric with respect to a center of conveyance of the medium, or the two heads of the first head are part of a plurality of heads arranged line symmetric with respect to the center of conveyance of the medium.

5. The printing apparatus according to claim 1, wherein the support unit includes a conveyance belt positioned below the two heads of the first head and the second head, and configured to convey the medium.

6. The printing apparatus according to claim 1, wherein the projecting member is biased toward the supporting surface.

7. The printing apparatus according to claim 6, wherein the projecting member is roller which is rotatable.

8. The printing apparatus according to claim 7, wherein the sensor has an arm extending along the conveyance direction and configured to support the roller to be rotatable.

9. The printing apparatus according to claim 8, wherein the arm has an inclined surface which is inclined with respect to the supporting surface to face an upstream side of the conveyance direction, the arm being configured to guide a forward end of the medium by the inclined surface.

10. The printing apparatus according to claim 8, wherein the arm pivots so as to move the roller in an up-down direction; and the sensor further includes a detector configured to detect a moving amount of a second end of the arm, which is opposite to a first end, of the arm, supporting the roller.

11. A printing apparatus comprising:

a head unit including:

a first head which has a nozzle surface having a nozzle group area in which a nozzle group configured to perform a printing on a medium is formed, a second head which has a nozzle group configured to perform the printing on the medium, and which is arranged downstream of the first head in a conveyance direction in which the medium is conveyed, a support unit which is arranged to face the head unit, and which has a support surface configured to support the medium;

a sensor which is arranged upstream of the nozzle group of the second head such that the sensor and the nozzle group of the second head overlap as seen in the conveyance direction, the sensor being arranged in a crossing direction crossing the conveyance direction at a position different from the nozzle group area of the first head, the sensor including a projecting member which projects toward the supporting surface with respect to the nozzle surface; and a guide mechanism which is arranged, in the conveyance direction, upstream of the head unit, and which is configured to perform positioning of the medium in a width direction with two guide plates arranged to face each other, wherein the sensor is arranged between a virtual line extending in the conveyance direction along a surface of one of the two guide plates without passing the first head, and an end of the nozzle group area of the first head defined on a side of the virtual line.

12. The printing apparatus according to claim 11, wherein the first head is part of a plurality of first heads arranged line symmetric with respect to a center of conveyance of the medium.

13. The printing apparatus according to claim 11, wherein the support unit includes a conveyance belt positioned below the two first heads and the second head, and configured to convey the medium.

14. The printing apparatus according to claim 11, wherein the projecting member is biased toward the supporting surface.

15. The printing apparatus according to claim 14, wherein the projecting member is roller which is rotatable.

16. The printing apparatus according to claim 15, wherein the sensor has an arm extending along the conveyance direction and configured to support the roller to be rotatable.

17. The printing apparatus according to claim 16, wherein the arm has an inclined surface which is inclined with respect to the supporting surface to face an upstream side of the conveyance direction, the arm being configured to guide a forward end of the medium by the inclined surface.

18. The printing apparatus according to claim 16, wherein the arm pivots so as to move the roller in an up-down direction; and the sensor further includes a detector configured to detect a moving amount of a second end of the arm, which is opposite to a first end, of the arm, supporting the roller.

* * * * *